US007171838B2

(12) United States Patent
Shiokawa

(10) Patent No.: US 7,171,838 B2
(45) Date of Patent: Feb. 6, 2007

(54) METHOD AND APPARATUS FOR PRODUCING THIN WALLED TUBULAR PRODUCT WITH THICK WALLED FLANGE

(75) Inventor: Seiji Shiokawa, Mishima (JP)

(73) Assignees: Minako Matsuoka, Mishima (JP); Hirohisa Shiokawa, Tokyo-to (JP); Akimasa Shiokawa, Tokyo-to (JP)

( * ) Notice: Subject to any disclaimer, the term of this patent is extended or adjusted under 35 U.S.C. 154(b) by 339 days.

(21) Appl. No.: 10/848,068

(22) Filed: May 19, 2004

(65) Prior Publication Data

US 2004/0244459 A1 Dec. 9, 2004

(30) Foreign Application Priority Data

Jun. 9, 2003 (JP) ..... 2003-163445

(51) Int. Cl.
*B21D 7/04* (2006.01)
*B21D 28/24* (2006.01)

(52) U.S. Cl. ..... 72/356; 72/347; 72/377; 72/370.11; 72/370.14; 72/355.2; 72/355.4; 72/355.6; 72/348

(58) Field of Classification Search ..... 72/379.2, 72/256, 370.1, 370.11, 370.15, 370.03, 356, 72/370.04, 347, 348
See application file for complete search history.

(56) References Cited

U.S. PATENT DOCUMENTS 1,048,046 A * 12/1912 Currey ..... 72/334
1,383,747 A * 7/1921 Noble ..... 29/888.451
1,966,053 A * 7/1934 Squires ..... 72/342.1
2,268,246 A * 12/1941 Dooley ..... 72/370.03
3,457,761 A * 7/1969 Brosseit ..... 72/325
4,400,965 A * 8/1983 Schey ..... 72/334
4,423,616 A * 1/1984 Pease ..... 72/348
4,453,395 A * 6/1984 Takeda et al. ..... 72/348
5,168,740 A * 12/1992 Griesemer ..... 72/349
5,329,799 A * 7/1994 Ito et al. ..... 72/340

FOREIGN PATENT DOCUMENTS

JP 2001001060 A * 1/2001

* cited by examiner

*Primary Examiner*—Dmitry Suhol
(74) *Attorney, Agent, or Firm*—Ditthavong & Mori, P.C.

(57) ABSTRACT

Method and apparatus for producing a thin walled tubular product with thickened flange. A first stage metalworking (drawing) of a circular plate material A is done by using a first die set 22 having a conical die 24 and a drawing punch 26 is done in a manner that the end of the blank plate is remained on the conical surface 24-1 of the die, so that a semi-finished tubular product A1 with a inclined flange A1-1 is obtained. Then, a second stage metalworking (drawing) of the semi-finished tubular product A1 is done by a second die set 32 having a shaping punch 34 and a restraint die 36. The semi-finished tubular product A1 is held by the restraint die 36 and the shaping punch 34 is introduced into the semi-finished tubular product A1 for effecting a wall thickness reduction under ironing principle while forming a stepped portion. Simultaneous with the execution of the second stage drawing, a flattening of the flange is done while restriction diameter expansion by a wall 40, thereby obtaining a thickened flattened flange A2-3.

6 Claims, 5 Drawing Sheets

Figure 1:
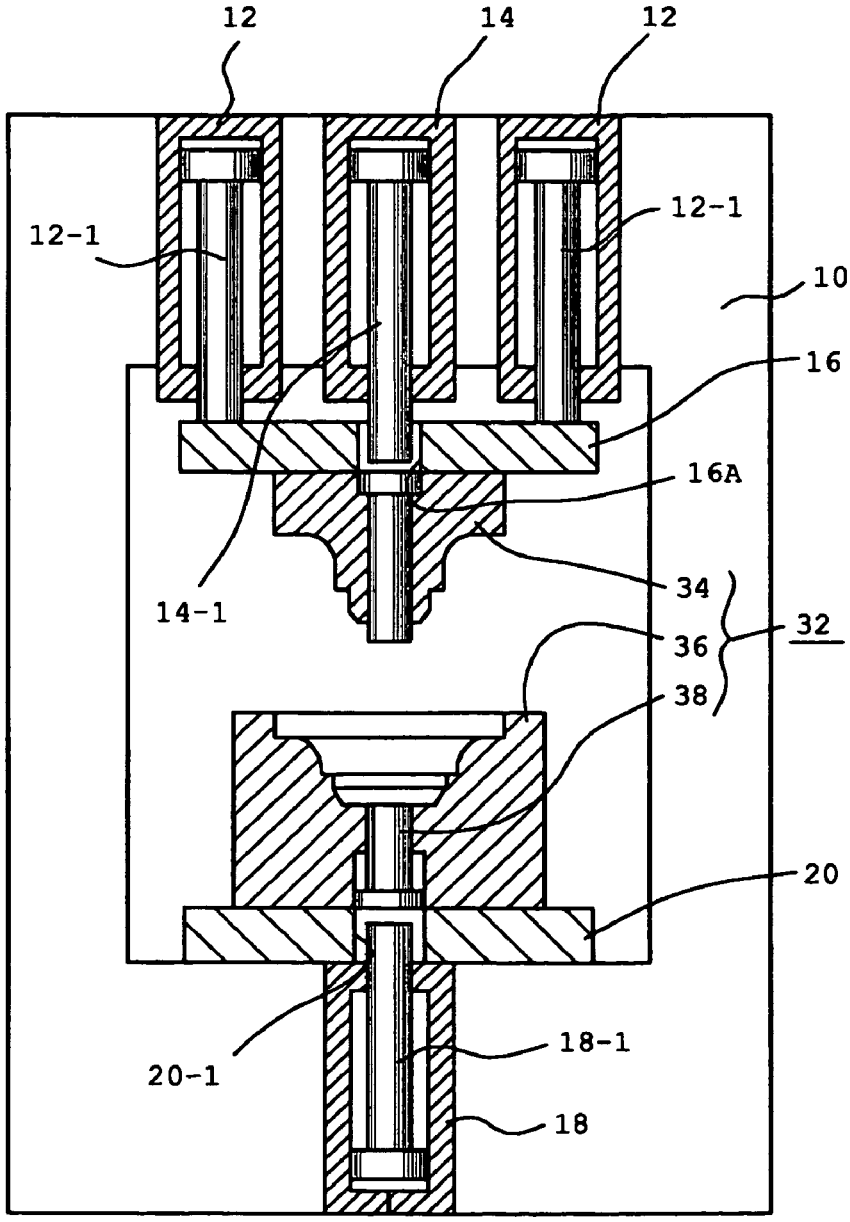

METHOD AND APPARATUS FOR PRODUCING THIN WALLED TUBULAR PRODUCT WITH THICK WALLED FLANGE

BACKGROUND OF THE INVENTION

1. Field of the Invention

The present invention relates to a method for forming, from a metal plate, a tubular product with a thickened flange portion, combined dies for a press apparatus, and a three axis press apparatus.

2. Description of Related Art

Japanese Un-Examined Patent Publication 2001-1060 discloses a method for forming a tubular product with a thickened flange portion from a metal plate (blank), wherein the metal plate is rested on a die of a circular conical shape and is subjected, as a first stage metal working, to a drawing by a punch. The drawing is ceased under a condition that the flange portion of the blank is still stayed on a circular conical surface of the circular conical shaped die, so that an semi-finished product of a cup shape having an inclined flange portion is obtained. The cup shaped semi-finished product is, then, subjected to a second stage metal working, wherein the inclined flange portion of the cup shaped semi-finished product blank is pressed, thereby obtaining a final product with a leveled flange portion of an increased thickness. In this prior art, a several percent increase in the thickness of the flange portion over the thickness of the blank plate is obtained. Namely, during the execution of the draw forming, an elongation is occurred at a portion of the material contacting with the punch, thereby reducing the thickness. However, at the end of the material contacting with the circular conical surface of the conical die, a reduction of the diameter is occurred, which causes the thickness to be increased over the wall thickness of the blank. However, in the prior art, a subsequent flattening of the inclined flange portion is done, which causes the outer diameter to be relatively increased. Due to the increase in the diameter by the flattening, some kind of thinning is occurred at the flange portion. Thus, a finally obtained increase in the wall thickness of the flange portion is limited to a several percent over the wall thickness of the blank. Therefore, in order to obtain a flange portion of an increased wall thickness exceeding several percent of the wall thickness of a blank, a combined process is essential, where a separate flange member of a desired wall thickness is prepared and a welding of separate flange member is done, resulting in a substantial increase in a production cost.

SUMMARY OF THE INVENTION

An object of the present invention is to provide a method and apparatus for forming a tubular product with a thickened flange portion from a metal plate, capable of overcoming the above-mentioned drawbacks encountered in the prior art.

Another object of the present invention is to provide a method and apparatus for producing a tubular product with a flange portion, capable of obtaining an increase in the thickness of the flange portion larger than several percent over the thickness of a blank.

Further another object of the present invention is to provide a method and apparatus for producing a tubular product with a thickened flange portion and thinned tubular portion, capable of obtaining a ratio of thickness of the flange portion to the thickness of a tubular portion exceeding a value of 2.0.

Still another object of the present invention is to provide a method and apparatus for producing a tubular product with a thickened flange portion and thinned tubular portion, capable of obtaining the product with mere two-stage metalworking.

According to the present invention, a method is provided for forming a thin walled tubular member with thickened flange portion, comprising steps of:

providing blank of a plate shape;

subjecting the plate shaped blank to a first stage drawing process by using a drawing die of conical shape in such a manner that a cup shaped semi-finished product having an inclined free end portion located on a conical surface of the drawing die is obtained, and;

subjecting said cup shaped semi-finished product to a second stage drawing process so that a cup shaped part of the semi-finished product is secondary drawn, while flattening said inclined free end portion of said semi-finished product, thereby obtaining a tubular product with a thickened flange portion.

Preferably, during the execution of flattening of said end portion of the semi-finished product, limiting in the outer diameter of the end portion of the semi-finished product to a predetermined value is done, thereby obtaining additionally increased thickness of the flange portion of the tubular product during the execution of flattening of said end portion of the semi-finished product, resulting in a further thickening the flange portion of the tubular product.

In the operation of the present invention, a blank as a plate shape is rested on the conical shaped drawing die, which is subjected to a drawing process by means of a punch. The drawing process is ceased under a condition that the blank is at its tail end stayed on the conical surface of the die, so that a semi-finished product of a cup shape with inclined flange is obtained. Then, a flattening or leveling of the flange is done with a free or restricted radial outward expansion. In case where such a restriction of a free radial expansion is done, the material, which otherwise will be freely flown in the radial outward direction, is flown in a thickness direction, which causes the thickness of the flattened or leveled part to be increased. As a result, only two stage metal working processes are enough for obtaining a tubular product with an increased thickness exceeding a several percent over the thickness of the blank plate. Namely, in case where an angle of the inclined flange as obtained by the first stage metal forming process is $\alpha$, an increased inclined flange of a thickness of $$\frac{t}{\cos\alpha}$$

is obtained, where t is a thickness of the blank plate. Namely, when the inclined angle is 45 degree, an increased wall thickness of value of $\sqrt{2}\times t$ is obtained. The larger the inclined angle, the larger the increased value in the thickness. However, an excessively increased thickness may likely cause a buckling to be generated during the execution of the leveling or flattening and, therefore, the upper limit of the inclination angle is roughly about 70 degree. When the value of the inclination angle is 60 degree, the wall thickness of $2\times t$ is obtained after the execution of the thickening. Furthermore, a reduced inclination angle causes the thickness increase to be reduced. Namely, when inclination angle is reduced to 30 degree, the wall thickness is reduced to $$\frac{2}{\sqrt{3}} \times t.$$

In short, in a range of the value of the inclination angle between 60 and 30 degree, the increased thickness between $\sqrt{2} \times t$ and $$\frac{2}{\sqrt{3}} \times t$$

is obtained. According to the present invention, a value of the inclination angle between 30 to 70 degree is selected in such a manner that a desired value of the increased wall thickness as required by the product is obtained.

According to an embodiment of the present invention, said second stage drawing of the cup shaped part of the semi-finished product is such that a forward and rearward combined extrusion forging is done for reducing a wall thickness of a tubular portion of the said cup shaped semi-finished product. Preferably, during the second stage drawing of the cup shaped part, an additional simultaneous drawing is done in such a manner that a stepped part is obtained at a location below the portion of the cup shaped part of said reduced thickness.

In this embodiment, the formation of the cup shaped part is done by the forward and rearward combined extrusion forging principle. Namely, ironing is done for reducing a wall thickness, resulting in a generation of an excess amount of extruded flow of metal, a major part of which is flown in a forward direction, while the remaining part is flown in a rearward direction. Under such an ironing operation, a wall thickness (t) reduction up to 55 percent over a thickness (T) of a blank pipe, i.e., $t=T\times0.55$, can be easily attained under single stage operation, while generating a sufficient amount of excessive flow of metal. During the above-mentioned forward and rearward combined extrusion forging, the excessive amount of metal flown in the forward direction is effective for supplementing the lacked amount of metal at a thinned wall portion of the tubular part as well as at the shoulder part of a stepped plane part as generated by a stretching force under a flow resistance when a pushed out type formation of a stepped and reduced diameter part is done at the side of a leading end. A major part of the excessive amount of metal under the ironing for wall thickness reduction is occurred in the forward direction. Contrary to this, only a small amount of the excessive metal flow is obtained in the rearward direction and is, however, still effective for preventing the wall thickness from being reduced at the flattened part irrespective of a wall thickness thinning as generated by pull-in effect of the flattened part.

According to another aspect of the present invention, a method is provided for forming a thin walled tubular member with thickened flange portion, comprising steps of:

providing blank of a plate shape;

subjecting the plate shaped blank to a first stage drawing process by using a drawing die of conical shape in such a manner that a cup shaped semi-finished product having an inclined free end portion located on a conical surface of the drawing die is obtained;

subjecting said cup shaped semi-finished product to a second stage drawing process by means of a die and a punch for obtaining a forward and rearward combined extrusion forging for obtaining a reduced thickness of a tubular portion of the cup shaped semi-finished product and for causing a stepped portion to be created at a location below said reduced thickness portion of the cup shaped portion, in a manner that the metal is, at the final stroke of the punch, flown to a shoulder portion of the stepped part and the reduced diameter part of the stepped portion and;

simultaneously with said second stage drawing, flattening said inclined free end portion of said semi-finished product, while limiting the outer diameter of the end portion of the semi-finished product to a predetermined value, thereby further thickening the flange portion of the tubular product, thereby obtaining a tubular product with a thickened flange portion.

In this aspect of the invention, only two stage metal workings (drawing processes) are sufficient to obtain a stepped tubular product having a thickened flange portion and an intermediate tubular portion of a reduced wall thickness. This is an advantage of the present invention over the prior art. Namely, in the prior art, in order to produce such a product a metal working, a system such as transfer press of three axes has been used, having working stations of elongated length and of a number exceeding 10, each station being provided with ejecting mechanisms at top and bottom sides, while using die sets exceeding a number of 10. Such a transfer process is itself of an increased cost. Furthermore, die set for three axis device of a number exceeding 10 are required, which causes the device cost as well as operating cost to be increased. As an alternative, a system may also possible, where a five axis pressing system with three die sets can be used. However, such five axis pressing system is complicated in its construction and expensive and lacks in flexibility in its way of use. This aspect of the present invention features the metal forming press constructed by two stage drawing processes, in which only two die sets are needed and a simplified and a flexible structure of pressing device of three axes can be employed, resulting in a highly reduction of cost over any conventional system.

Preferably, said first stage drawing process of the plate shaped blank by means of said drawing die of conical shape is such that said inclined end has an angle of an inclination in a range between 30° and 70°. As a result, a cup shaped part of angle of the inclined end between 30° and 70° is obtained from the blank plate. Furthermore, by an employment of flattening while restricting a radially outward expansion, a maximum theoretical increase in wall thickness of $$1 \times \frac{1}{\cos 45} = t \times \sqrt{2}$$

is obtained when the value of the angle is 45° is obtained. By a value of the angle exceeding 45°, an increased degree of thickening of the wall is obtained, which, however, causes the buckling to be likely during the execution of the flattening operation. Thus, a value of the inclination smaller than 70° is desirably in that an effective thickening of the wall is obtained while preventing the buckling during the flattening.

During said first stage drawing process of the plate shaped blank by means of said drawing die of conical shape for a formation of said cup shaped semi-finished product, piercing can be preferably done at a bottom of said cup shaped part. Due to the simultaneous piercing at the bottom of the semi-finished cup shaped product during the drawing or wall thickness reduction of a tubular part, an increase in production efficiency is obtained, on one hand and, on the other hand, a well-balanced metal flow during the processing is obtained.

In still another aspect of the invention, a die assembly is provided for a press-working device, comprising;

a first die set for a diameter reducing drawing having a conical die and a drawing punch, which is for executing a diameter reducing drawing of a plate shaped blank in such a manner that said plate shaped blank is largely rested on the conical surface of the conical die, thereby obtaining a cup shaped semi-finished product having an inclined free end, and;

a second die set having a die and a punch for executing a second stage drawing of a cup shaped portion of said cup shaped semi-finished product and for flattening said inclined end of said semi-finished product, thereby obtaining a tubular product with a thickened flange portion.

In this aspect of the invention, a plate shaped blank is rested on the conical surface of the die and the first stage metal forming process using the first die set is executed, wherein the plate shaped blank is subjected to a drawing by means of the drawing punch. The first stage metal forming process is ceased when the free edge portion of the plate shaped blank is remained on the conical surface of the die in a manner that a cup shaped semi-finished produce having an inclined end portion is obtained. Then, the second stage metal forming using the second die set is executed, wherein an additional drawing of a cup shaped part as well as flattening of the inclined end part are simultaneously executed, while a free expansion in a radially outward direction is prevented when it is necessary. According to the present invention, only two die sets, that are the first and the second die sets, are enough to obtain a tubular product of non-uniform wall thickness with thickened end flange, thereby obtaining a reduced cost.

In a further aspect of the present invention, a pressing apparatus is provided, comprising:

a three axis driving mechanism having two operating cylinders on one side and an operating cylinder on the other side;

a first die set comprising a drawing die of a conical shape, a drawing punch, a piercing punch and a work ejecting head which is able to function also as a piercing die;

a second die set comprising a shaping punch, a confining die, an inner holding punch, a bottom counter punch and a die and a punch functioned as also for piercing;

said shaping punch and said confining die in second die set having an outer limiting wall for preventing an outer diameter from being increased which a highly thickened flattened end of a material to be processed is needed;

in said first die set, a connection to said cylinders being such that said drawing punch and said piercing punch cooperate with said two cylinders on said one side while said work ejecting head cooperates with said one operating cylinder on the other side;

in said second die set, a connection to said cylinders being such that said shaping punch and said inner punch cooperate with said two cylinders on one side, while said bottom counter punch cooperating with said other operating cylinder on the other side.

In this aspect of the invention, the blank plate is rested on a drawing punch and a drawing by the drawing punch is executed and the drawing is ceased such that the end of the blank is still rested on the conical surface of the drawing die. When it is necessary, a piercing is simultaneously done at the bottom by means of piercing punch and die. In this way, the first stage metalworking is finished, so that a cup shaped semi-finished product with an inclined flange and with an optional bottom pierced end. The product is, then, subjected to an ejection, which is followed by a second stage metal working by means of a second die set. In the second stage metal working, the semi-finished product is rested on the confining die and is held between the inner holding punch and the bottom counter punch. Then, by the shaping punch, a second stage drawing simultaneous with a flattening is done. Namely, the flange at the top end is flattened, while a restricting member restricts the outer periphery when it is necessary for obtaining an additional thickening of the flange. Simultaneous with the flattening at the top end, the tubular part is subjected to a second stage drawing in which a forward and rearward combined extrusion forging is done. Furthermore, a lower portion is, simultaneously, subjected to an extrusion (pushing out) so that a stepped part of reduced diameter is formed when it is necessary. A part of the excess metal as generated by the extrusion forging is, at the lower side, flown toward the diameter reduced part, so that a supplementation of the metal is done at the reduced diameter part, which otherwise would cause the metal lacked because of the stretching load as generated by a resistance at the stepped part. The remaining small part of the excess metal is flown upwardly, so that a reduction in thinning in the wall thickness as generated by a pulling-in effect is, more or less, mitigated. A finishing of the stepped, a thinned wall tubular product with thickened flange portion is thus completed. The finished product is removed by moving the lower counter punch upwardly. In short, in this aspect of the invention, two stages of a metal working by a three axis pressing device with only two die set is enough to obtain a thinned wall tubular product with thickened flange portion, thereby reducing production cost from the view point of the cost of die sets as well as of the running cost. In short, a highly reduced production cost is obtained by the present invention.

BRIEF EXPLANATION OF ATTACHED DRAWINGS

FIG. 1 is a schematic side view of a three axis-pressing machine used for practicing the present invention.

Figure 2A:
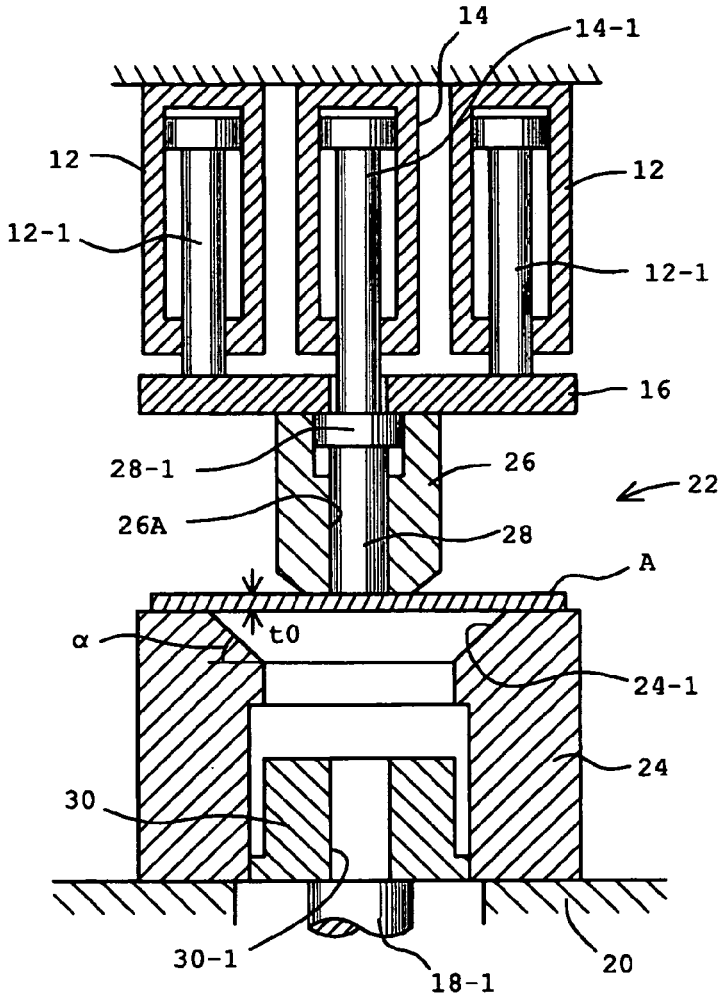

FIG. 2*a* illustrates a first stage metal working for producing a semi-finished product by the pressing machine in FIG. 1, which is under a retracted condition.

Figure 2B:
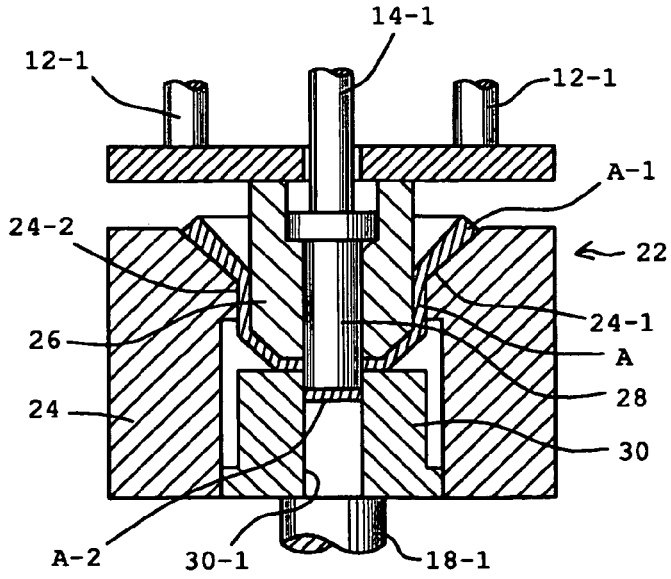

FIG. 2*b* is the same as FIG. 2*a* but illustrates an operating condition of the pressing machine.

Figure 3:
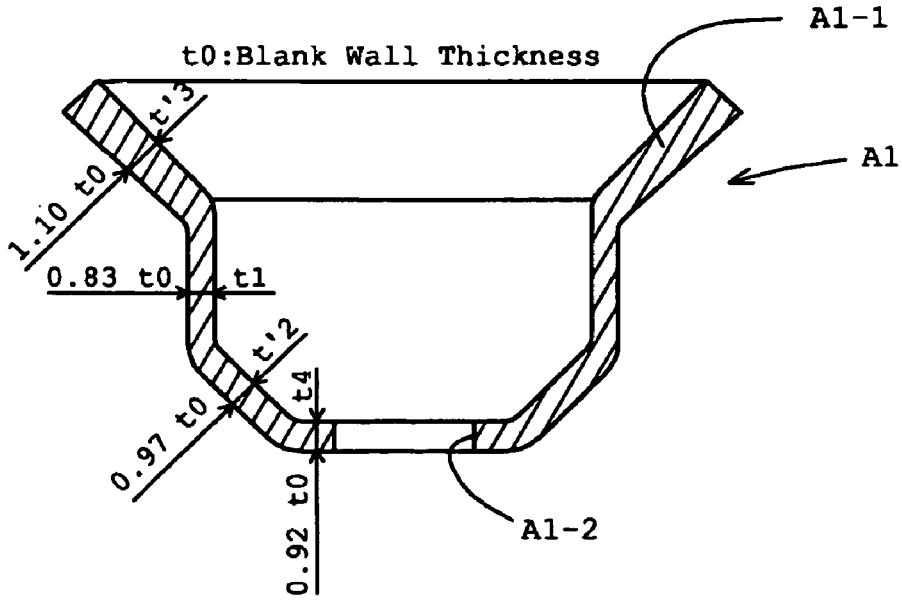

FIG. 3 is a cross-sectional view of a semi-finished product obtained by the pressing machine in FIG. 1.

Figure 4A:
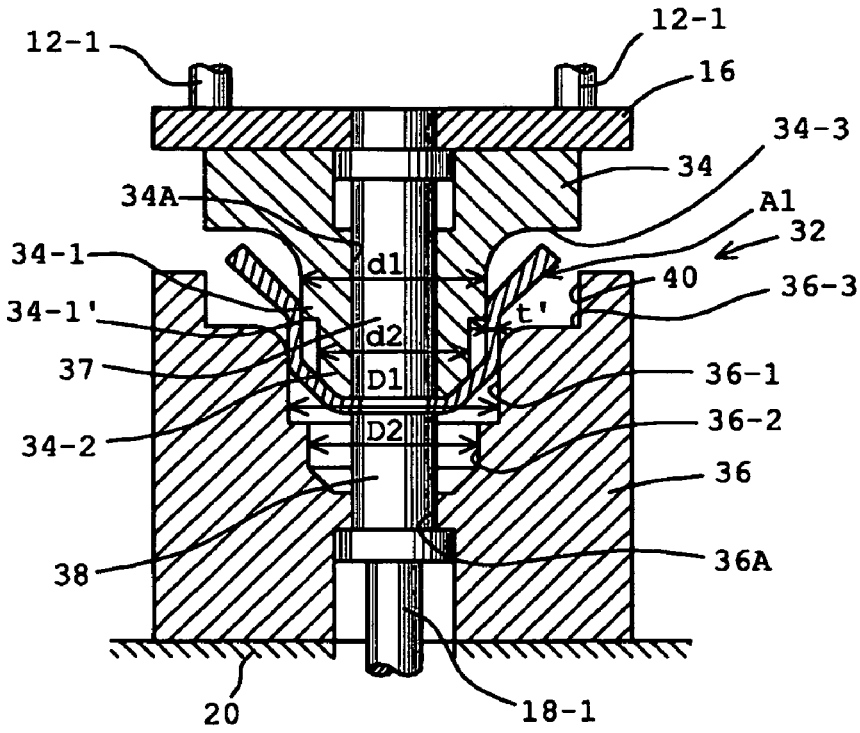

FIG. 4*a* illustrates a second stage metal working for producing, from the semi-finished product in FIG. 3, a final product by the pressing machine in FIG. 1, which is under a retracted condition.

Figure 4B:
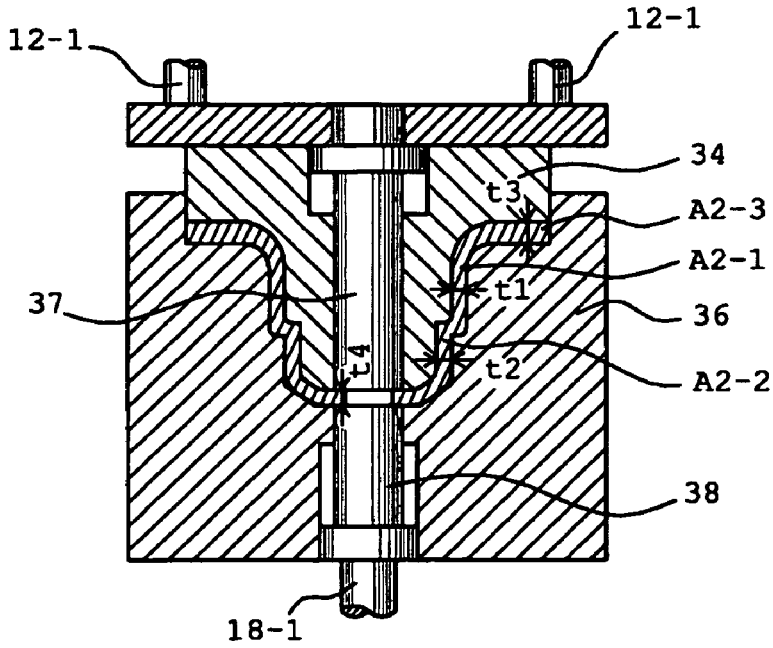

FIG. 4*b* is the same as FIG. 4*a* but illustrates an operating condition of the pressing machine.

Figure 5:
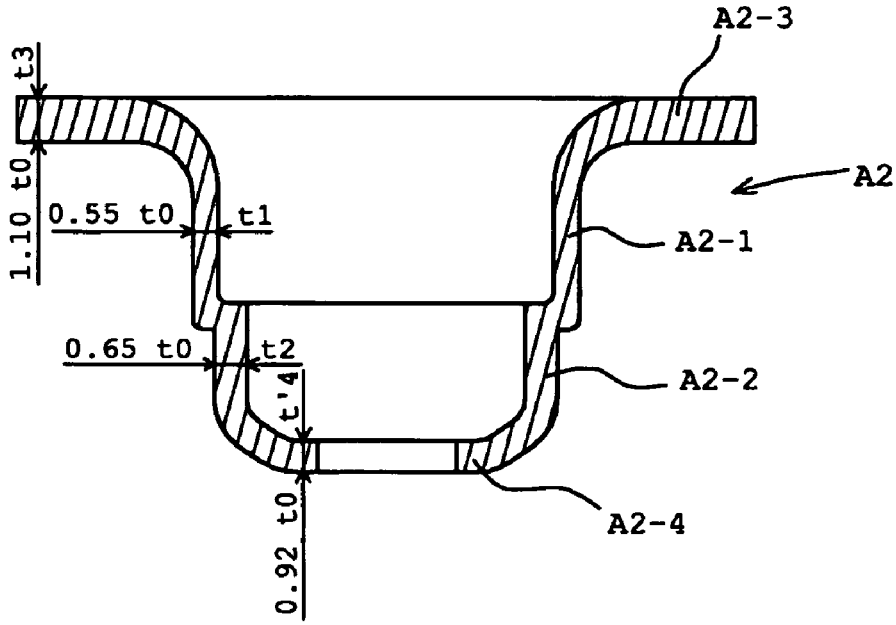

FIG. 5 is a cross-sectional view of a final product after the completion of the second stage metal working process.

DETAILED EXPLANATION OF PREFERRED EMBODIMENT

Referring to FIG. 1, an embodiment of the present invention embodied as a hydraulic pressing apparatus of a three-axis type is schematically illustrated. The apparatus is shown in a condition that a second die set 32 as described later in more detail is mounted. The apparatus is provided with a frame 10, on the upper part of which a pair of laterally spaced first hydraulic cylinders 12 as a first axis unit as well as a central second hydraulic cylinder 14 as a second axis unit are provided. The first hydraulic cylinder 12 has a piston rod 12-1 having a bottom end, which is in connection with a slide table 16. The second hydraulic cylinder 14 has a piston rod 14-1, which is freely passed through an opening 16A formed at the center of the slide table 16. Arranged at the lower part of the main frame 10 is a hydraulic cylinder 18, which constructs a third axis unit. The hydraulic cylinder 18 has a piston rod 18-1 having an upper end passed freely through a central opening 20-1 in a bolster table 20, which is rested on the frame 10. In place of the hydraulic cylinder, any type of known actuator devices may be employed, including those using a pneumatic pressure, an elastic force or a spring force et al. The actuator is not necessarily arranged inside the frame 10 as is shown in FIG. 1 and may, as an alternative, be arranged inside a die or die set. Furthermore, in place of the hydraulic pressing machine, a mechanical pressing device may be used. In this case, in place of the hydraulic cylinder 12, a crank toggle member is used. Furthermore, a second hydraulic cylinder 14 is arranged at the center of a slide table 6 having a desired thickness as is the third cylinder 18 mounted to the main frame 10.

In an embodiment of the present invention, a first stage metal forming is done while mounting a first die set to the three axis hydraulic pressing machine in FIG. 1 to obtain a semi-finished product of a cup shape having an inclined free end (flange portion). Then, a second stage metal forming process is done by using a second die set, wherein an additional drawing of a cup shaped part of the semi-finished product as well as an ejecting diameter reduction are done and simultaneously a flattening of the inclined flange portion is done, thereby obtaining a stepped tubular product of reduced wall thickness with thickened flange portion. Now, a detail of the first and the second stage metal forming processes by the first and second die sets, respectively will now be explained. In FIG. 2, a reference numeral 22 denotes a first die set, which is constructed by a conical drawing die 24 arranged on a bolster table 29 at the lower part of the frame of the three axis pressing device, a drawing punch 26 at the upper part of the pressing device, a piercing punch 28 slidably inserted to the central opening 26A of the drawing punch 26, and a knockout head 30 which serves also as a piercing die. The knockout head 30 is advantageously formed with a die opening 30-1, which cooperates with the piercing punch 28 for causing the work piece to be pierced. The conical die 26 is itself known and has conventionally used for a drawing operation without necessitating blank holder. The drawing die 24 has, at its top end, a conical surface 24-1, the inclined angle of which is, preferably, in a range between 30 and 70 degree. During the press working, the blank plate is subjected to a diameter reduction, while being guided by the conical surface 24-1, so that a desired drawing of the blank plate is obtained without necessitating any blank holder, i.e., without generating any wrinkle. According to the present invention, the drawing process is ceased under a condition that the blank plate A is, at its end, stayed on the conical surface 24-1 of the die 24, so that a semi-finished product A1 having an inclined flange portion A1-1 as shown in FIG. 3 is obtained. The semi-finished product A is then subjected to a second stage drawing while the inclined flange portion A1-1 being subjected a flattening together with a restriction of a diameter increase when it is necessary.

In FIG. 4, a reference numeral 32 denotes a second die set 32, which is constructed by a shaping punch 34 having an upper end connected the slide table 16, a restraint die 36 on the bolster table 20, an inner holding punch 37, which slides vertically in a central opening 34A of the shaping punch 34 and a lower counter punch 38, which slides in a central opening 36A of the restraint die and serves also as a knockout head. The cup shaped semi-product A1 as obtained by the first die set 22 in the first stage metalworking is, at its tubular part, subjected to ironing for a thickness and diameter reduction. During the execution of such a thickness and diameter reduction, the inclined portion of the cup shaped semi-finished product is subjected to a flattening or leveling by the shaping punch 34 and the restraint die 36, so that a final product A2 (FIG. 5) is obtained. During the execution of the flattening, a restraint of the outer diameter is, if necessary, done in order to obtain a further increased wall thickness by a provision of a radial expansion prevention wall 40 as an annular vertically raised portion at an upper outer periphery of the restraint die 36.

Next, a method for executing a metal forming of a stepped tubular product with a thickened end portion (flange) by a first and second die sets 22 and 32 on a three axis pressing machine according to the present invention will be explained. First, as shown in FIG. 2*a*, the first die set 22 is mounted onto the three axis pressing machine as for executing the first stage metal working. Namely, the conical die 24 for a drawing and a knock out head 30 functioning as also for piercing die are rested on a bolster table 20 located at the lower part of the three axis pressing machine. Furthermore, the piercing punch 28 is inserted into the opening 26A of the drawing punch 26 in such a manner that the piercing punch 28 is, at its upper flange portion 28-1, oppositely faced with the lower end of the piston rod 14-1 of the hydraulic cylinder 14, which constructs a second axis of the pressing device. As shown in FIG. 2*a*, the plate shaped blank A of a thickness of to is rested on the conical die 24 for executing a drawing. Then, the first axis hydraulic cylinder 12 is opened to a hydraulic pressure source or a crank device is, when a mechanical pressing device is employed, operated, so that the piston rod 12-1 is extended or moved downwardly, which causes the slide table 16 is lowered. As a result, the drawing punch 26 at the lower side of the slide table 16 is lowered toward the blank plate A, so that a drawing of the blank plate A by means of the drawing, conical die 24 is commenced. During the execution of the drawing by the drawing die 24, the blank plate A is, at its end portion, guided by the conical surface 24-1 of an inclination angle of a, so that the outer diameter is gradually reduced. As a result of such a guiding action on the conical surface 24-1, a drawing operation without occurrence of any wrinkle can be practiced without using blank holder. The first stage metal working is finished when the blank plate A is pressed to the upper surface of the knockout head 30 by means of the bottom end of the drawing punch 26 as shown in FIG. 2*b*. At this finished state of the first stage metal forming, a relatively large length of the end portion A-1 of the blank plate is stayed on the conical surface 24-1, as shown in FIG. 2*b*. Therefore, the end portion A-1 of the blank plate is under an inclined condition. Then, a hydraulic circuit (not shown) is operated in such a manner that the piston rod 14-1 of the hydraulic cylinder 14 constructing the second operating axis of the three axis pressing machine is extended downwardly. As a result, the piercing punch 28 engaging with the piston rod 14-1 is cooperated with the die opening 30-1, so that a circular hole is formed at the bottom end of the blank plate A, while a slug A-2 is obtained. Then, in the upward direction, the slide table 16 is retracted while the piston rod 18-1 as the third axis of the three axis hydraulic cylinder is extended. Furthermore, the knockout head 30 is moved upwardly, so that a drawn product A1 as semi-finished cup shaped product is ejected, which is, as shown in FIG. 3, constructed by an upper inclined flange portion A1-1 of an increased thickness, a bottom portion A1-2 of a reduced wall thickness having an opening 39, a straight tubular portion A1-3 of reduced wall thickness connecting from the top portion A1-1 and a tapered taper potion A1-4 connecting the portion A1-3 with the bottom portion A1-2. In a preferred example of the product A1, with respect to the blank plate of the thickness of $t_0$, an increased thickness of a value of $t'3=t_0\times1.10$ at the flange portion A1-1 as well as a reduced thickness of $t'4\approx t_0\times0.92$ at the bottom part A1-2 are obtained. As to the tubular portion A1-3 and the A1-4, values of reduced thickness are obtained, which are expressed $t'1\cong t_0\times0.83$ and $t'2\cong t_0\times0.97$, respectively.

The thus obtained semi-finished product A1 is subjected to a second stage metal working. Namely, as shown in FIG. 4, the restraint die 36, to the central opening 36A of which the bottom counter punch 38 is inserted, is rested on the bolster table 20 at the lower part of the three axis pressing machine. The shaping punch 34, to the central opening 34A of which the inner holding punch 37 is inserted, is mounted to the slide table 16 at the upper part of the three axis pressing machine. The semi-finished product A1 obtained at the first stage metal working is inserted to the restraint die 36 as shown in FIG. 4*a*. At the first phase of the processing, the piston rod 18-1 of the third axis hydraulic cylinder is extended, so that the bottom counter punch 38 is moved to the upper limit position. As a result, the bottom surface of the semi-finished product A1 is pressed to the bottom end surface of the inner holding punch 37. In other words, the bottom portion of the semi-finished product A1 is, at its upper and lower surfaces, held between the punches 37 and 38. Under the condition that the bottom surface of the semi-finished product is held between the punches 34 and 37, the piston rods 12-1 are extended, so that the slide table 16 is moved downwardly, which causes the shaping punch 34 to be lowered. As a result, the shaping punch 34 together with the semi-finished product held thereby is moved into the shaping cavity of the restraint die 36, so that a wall thickness reduction as well as a diameter reduction of the work piece between the shaping punch 34 and the restraint die 36 is obtained. Namely, the shaping punch 34 is provided with an upper first shaping part 34-1 of a larger diameter of d1 and a lower second shaping part 34-2 of a smaller diameter of d2. Furthermore, the first shaping part 34-1 has a lower edge 34-1' of a slightly rounded shape. In conformity with the stepped shape of the shaping punch 34, the restraint die 36 has a cavity of stepped shape constructed by a large diameter portion 36-1 of a diameter of D1 and a small diameter portion of a diameter of D2. When the shaping punch 34 is lowered, the first shaping portion 34-1 is moved into the large diameter portion 36-1 of a diameter of D1 and the second shaping portion 34-2 into the small diameter portion 36-2 of a diameter of D2. As a result, the tubular part A1-3 of the semi-finished product A1 is subjected to a wall thickness reduction under an ironing action occurred between the first shaping portion 34-1 of the shaping punch 34 and the large diameter portion 36-1 (of diameter of D1) of the cavity of the restraint die 36 and the tapered part A1-4 of the semi-finished product A1 is subjected to a wall thickness reduction between the second shaping portion 34-2 of the shaping punch 34 and the small diameter portion 36-2 (of diameter of D2) of the cavity of the restraint die 36. In more detail, a drawing operation for a wall thickness reduction by means of the first shaping portion 34-1 is commenced smoothly thanks to the rounded bottom end 34-1' of the first shaping portion 34-1. Furthermore, the large diameter portion 36-1 in the shaping cavity of restraint die 36 has a diameter D1, which is smaller than the diameter d1 of the shaping portion 34-1 plus the twice of the wall thickness t'1 of the tubular portion A1-3 of the semi-finished product A1, which wall thickness is slightly smaller than the thickness of the blank plate A as a result of the execution of the first stage metal working process, so that the descending movement of the first shaping portion causes the work piece to be subjected to an ironing, thereby reducing the wall thickness. It is found by tests by the inventor that a wall thickness reduction ratio as small as 0.55 can easily attained. By the wall thickness reduction by such ironing a plastic flow of an excess amount of metal is generated. Most of the flow of such an excess amount of metal is generated in the downward direction, which serves to prolong the tubular part. The remaining flow of the metal can be generated in the upward direction. The metal flown in the downward direction is utilized for supplementing metal to a reduced diameter portion and a stepped shoulder portion, which are subjected to a wall thickness reduction under a stretching. Namely, by an insertion of the second shaping part 34-2 of the shaping punch 34 to the small diameter portion 36-2 of diameter of D2 in the cavity of the restraint die 36, a diameter reduction of the tapered tubular portion A1-4 of the semi-finished product A1 (FIG. 3) as well as a creation of a stepped portion between the large diameter portion and the small diameter portion are simultaneously occurred, which however does not cause a shortage in a metal amount to be occurred due to a compensation effect as obtained by a downward flow of excessive amount metal as generated by the wall thickness reduction under the ironing. As a result, a desired metal forming of the stepped shaped part can be practiced.

FIG. 4*b* illustrates a full stroke condition wherein the shaping punch 34 is fully inserted to the cavity of the restraint die 36, so that a tubular portion A2-1 of a wall thickness $t_1$ and a reduced diameter part A2-3 of a diameter $t_2$ of about ⅔ of the thickness $t_0$ of the blank pipe. In FIG. 5, an example of a finished product having portions A2-1 to A2-4 of shown values of respective wall thickness is illustrated. Namely, as far as the portions A2-3 and A2-4 are concerned, the wall thickness values $t3\cong1.10\times t_0$ and $t4\cong0.92\times t_0$ are the same as those t'3 and t'4 of the semi-finished product. However, as far as the portions A2-1 and A2-2 are concerned, the wall thickness are reduced to values of $t1\cong0.55\times t_0$ and $t2\cong0.65\times t_0$. Namely, this shows that the metal supplementing function according to the present invention makes it possible that the final product is obtained only by two stage metal working processes with out any metal flow shortage. In other words, if any metal supplementation were not obtained, a stretching is merely generated during the two-stage metalworking, which would cause the work piece to be broken or torn off. Contrary to this, a metal supplementation under the ironing according to the present invention allows the work piece to be desirably shaped to the stepped product under the two stage metal working.

Simultaneously with the wall thickness reduction and a diameter reduction at the tubular portion, the shaping punch 34 contacts, at its flat bottom surface 34-3, with the inclined end portion 34-3 of an angle of 45° of the semi-finished product, so that a flattening is practiced, i.e., the portion is pressed to the faced surface 36-3. During the flattening, a radial expansion of the inclined end is limited or blocked by the radial expansion prevention wall 40, so that a flange portion A2-3 of the increased thickness t3, which is equal to $$t_0 \times \frac{1}{\cos 45} = \sqrt{2} \cong 1.4$$

is obtained in case where the inclined angle of the portion A1-1 (FIG. 3) is 45°. A wall thickness increased during the flattening of the portion A2-3 is assisted by the metal flow in the upward direction as generated by the ironing of the tubular portion. The wall thickness as obtained when the inclination angle α is 45° is t×√2. Furthermore, by increasing the value of the inclination angle α, further increase value of the wall thickness is obtained.

After the formation of a cup shaped product A2 of a reduced wall thickness with a thick flange portion, the piston rod 12-1 of the hydraulic cylinder as a first axis of the three axis hydraulic press machine is retracted or a retraction of a crank member is done in case of a mechanical press machine, so that the shaping punch 34 is retracted from a shaping cavity of the restraint die 36 is retracted. Furthermore, the piston rod 18 of the hydraulic cylinder 18 as the third axis of the three axis pressing machine is extended, so that the lower counter punch 38 is elevated, so that the latter functions as a knock out head, resulting in a ejection of the final product. FIG. 5 illustrates an ejected finally finished product A2, which is provided with a thin walled tubular part A2-1, a reduced diameter part A2-2 of a increased wall thickness of about ⅔ of wall thickness of a blank plate, an end part A2-3 of increased wall thickness of increased ratio larger than 1.1 with respect to the wall thickness of a blank plate and a bottom wall part A2-4 having an opening.

In the illustrated embodiment, the radial expansion prevention wall 40 is provided in the restraint die 36 in the described embodiment. However, as an alternative, a radial expansion prevention wall of the same function may be provided in the shaping punch 34.

The invention claimed is:

1. A method for forming a thin walled tubular member with thickened flange portion, comprising:

providing blank of a plate shape;

subjecting the plate shaped blank to a first stage drawing process by using a drawing die of conical shape in such a manner that a cup shaped semi-finished product having an inclined free end portion located on a conical surface of the drawing die is obtained; and subjecting said cup shaped semi-finished product to a second stage drawing process so that a cup shaped part of the semi-finished product is secondary drawn, while flattening said inclined free end portion of said semi-finished product, thereby obtaining a tubular product with a thickened flange portion, wherein, during the execution of flattening of said end portion of the semi-finished product, limiting in the outer diameter of the end portion of the semi-finished product to a predetermined value is done, thereby obtaining additionally increased thickness of the flange portion of the tubular product, and wherein, during the second stage drawing of the cup shaped part, an additional simultaneous drawing is done for obtaining a stepped part at a location below the portion of the cup shaped part of said reduced thickness.

2. A method according to claim 1, wherein said second stage drawing of the cup shaped part of the semi-finished product is such that a forward and rearward combined extrusion forging is done for reducing a wall thickness of a tubular portion of said cup shaped semi-finished product.

3. A method according to claim 1, wherein said first stage drawing process of the plate shaped blank by means of said drawing die of conical shape is such that said inclined end has an angle of an inclination in a range between 30° and 70°.

4. A method according to claim 1, wherein, during said first stage drawing process of the plate shaped blank by means of said drawing die of conical shape for a formation of said cup shaped semi-finished product, piercing is done at a bottom of said cup shaped part.

5. A method for forming a thin walled tubular member with thickened flange portion, comprising:

providing blank of a plate shape;

subjecting the plate shaped blank to a first stage drawing process by using a drawing die of conical shape in such a manner that a cup shaped semi-finished product having an inclined free end portion located on a conical surface of the drawing die is obtained;

subjecting said cup shaped semi-finished product to a second stage drawing process by means of a die and a punch for obtaining a forward and rearward combined extrusion forging for obtaining a reduced thickness of a tubular portion of the cup shaped semi-finished product and for causing a stepped portion to be created at a location below said reduced thickness portion of the cup shaped portion, in a manner that the metal is, at the final stroke of the punch, flown to a shoulder portion of the stepped part and the reduced diameter part of the stepped portion; and simultaneously with said second stage drawing, flattening said inclined free end portion of said semi-finished product, while limiting the outer diameter of the end portion of the semi-finished product to a predetermined value, thereby further thickening the flange portion of the tubular product, thereby obtaining a tubular product with a thickened flange portion.

6. A pressing apparatus comprising:

a three axis driving mechanism having two operating cylinders on one side and an operating cylinder on the other side;

a first die set comprising a drawing die of a conical shape, a drawing punch, a piercing punch and a work ejecting head which is able to function also as a piercing die;

a second die set comprising a shaping punch, a confining die, an inner holding punch, a bottom counter punch and a die and a punch functioned as also for piercing;

said shaping punch and said confining die in second die set having an outer limiting wall for preventing an outer diameter from being increased which a highly thickened flattened end of a material to be processed is needed;

in said first die set, a connection to said cylinders being such that said drawing punch and said piercing punch cooperate with said two cylinders on said one side while said work ejecting head cooperates with said one operating cylinder on the other side;

in said second die set, a connection to said cylinders being such that said shaping punch and said inner punch cooperate with said two cylinders on one side, while said bottom counter punch cooperating with said other operating cylinder on the other side.

* * * * *